United States Patent [19]

Ishii et al.

[11] 4,063,510

[45] Dec. 20, 1977

[54] PROCESS FOR DETECTING A MISFIRED EXPLOSIVE

[75] Inventors: Yasuo Ishii, Yotsukaido; Naozumi Nishimura; Kohei Abe, both of Sendai, all of Japan

[73] Assignees: Taisei Kensetsu Kabushiki Kaisha, Tokyo; Tohoku Kinzoku Kogyo Kabushiki Kaisha, both of Japan

[21] Appl. No.: 714,959

[22] Filed: Aug. 16, 1976

[30] Foreign Application Priority Data

Aug. 29, 1975 Japan ..... 50-103905

[51] Int. Cl.[2] ..... F42D 5/02

[52] U.S. Cl. ..... 102/23

[58] Field of Search ..... 102/22-24

[56] References Cited

U.S. PATENT DOCUMENTS

| | | | |
|---|---|---|---|
| 3,082,689 | 3/1963 | Griffith et al. | 102/24 |
| 3,772,099 | 11/1973 | Ryan et al. | 102/24 |
| 3,954,058 | 5/1976 | Sanders et al. | 102/30 |

*Primary Examiner*—Verlin R. Pendegrass

*Attorney, Agent, or Firm*—Wenderoth, Lind & Ponack

[57] ABSTRACT

A process for indirectly detecting a misfired explosive (cartridge) which comprises charging a ferrite magnet as a tracer in an explosive charging portion together with an explosive in a blasting method and detecting the magnetic flux of said magnet charged in a misfired explosive cartridge at a site of explosion after blasting by a magnet measuring instrument, characterized by using as said tracer a ferrite magnet calcined at a temperature less than 1000° C. and detecting this magnet by said magnetic detector.

12 Claims, 24 Drawing Figures

PROCESS FOR DETECTING A MISFIRED EXPLOSIVE

Heretofore, upon driving tunnels of rock and ore and mining rock and ore, a process which comprises making holes by rock drills, inserting explosives and detonators into said holes and exploding said explosives, thereby crushing the rock and ore has been generally adopted.

However, at times a so-called "misfired explosive" phenomenon occurs in which a part of the explosive explodes, but another part thereof remains non-exploded. Checking of this misfired explosive has heretofore been carried out only by careful checking with the naked eyes after blasting and complete discovery of a misfired explosive has been impossible.

Accordingly, there has been many instances in which a misfired explosive is accidentally touched by a drilling bit upon drilling by a rock drill, resulting in occurrence of death of miners and a grave disaster.

The present invention is proposed in view of such actual situations, relating to a process for detecting a misfired explosive which comprises inserting a magnetic substance to the tip of an explosive or inserting a magnetic substance along an explosive, charging the explosive into an explosive charging cylinder charged with a magnetic substance, directing inserting a magnetic substance into an explosive or kneading magnetic powder material into an explosive, using a magnetized explosive and detecting a misfired explosive and a residual magnetic substance by a magnetic detector after blasting to discover the misfired explosive in a blasting method.

An object of the present invention is to easily and certainly detect a misfired explosive even when a misfire occurs in a part of a face at the time of explosion to prevent a disaster in advance.

The present invention also relates to an apparatus for detecting a misfired explosive in a blasting method, characterized by charging a magnetic substance remaining with a misfired explosive to be detected by a magnetic detector, and by this apparatus said process for detecting a misfired explosive is certainly carried out.

Said explosive which is magnetized after magnetic material powder is directly kneaded with an explosive, is capable of being detected of a misfired explosive, besides being able to be used for detecting a misfired explosive mixed with a muck, detecting a lost explosive and as an explosive for preventing theft.

In the accompanying drawings,

FIGS. 6A, 6B to FIGS 9A, are front and longitudinal sections showing embodiments of the magnetic substance used in the present invention, respectively.

Next, the characteristics in terms of kind of a magnet used as a dynamite tracer will be explained hereinbelow. 1. The characteristics in terms of kind of a magnet as a dynamite tracer:

a. An explosive for detecting a misfired explosive in which at least a part of a magnet substance (rod-like or hollow rod-like magnet) is covered with an explosive:

This explosive is characterized by covering at least a part of a permanent magnet high in electric resistance with an explosive. An object of this explosive resides in causing broken pieces of the permanent magnet not to remain on a face after blasting when an explosive charged in an explosive charging hole explodes completely and causing detection of a misfired explosive to be carried out precisely.

In case a permanent magnet to be incorporated into this explosive is conductive, there is a danger of explosion by an induced current, therefore, a permanent magnet high in electric resistance such as ferrite magnet is suitable, however, other magnets are also usable after insulating the surfaces thereof.

Hereinbelow, the present invention will be explained by reference to illustrated embodiments.

Figure 1A:
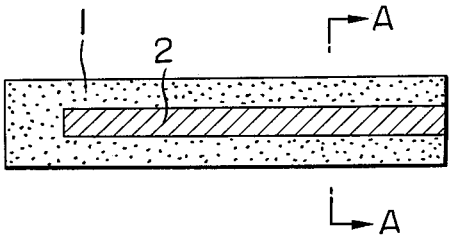
FIG. 1A is a longitudianl section showing one embodiment of the explosive used for the present invention.
Figure 1B:
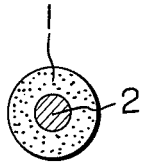
FIG. 1B is a section taken along the line A — A of FIG. 1A.

In FIG. 1, reference numeral 1 denotes an explosive having a diameter of 25 mm and a length of 140 mm, along the central axis of said explosive, a rod-like ferrite magnet having a diameter of 10 mm and a length of 120 mm 2 is inserted into said explosive, the sectional area of the ferrite magnet 2 exposes only on one end surface of the explosive 1 while the other end of said ferrite magnet 2 is covered with the explosive 1.

Figure 2:
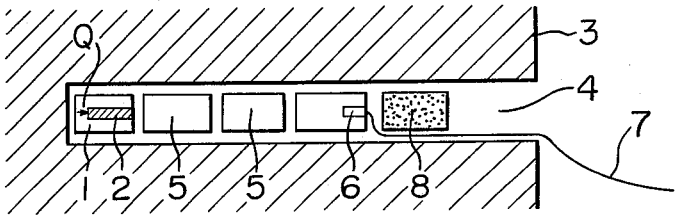
FIG. 2 is a longitudinal section showing the using state of the explosive shown in FIGS. 1A and 1B.

The explosive 1 inserted with said ferrite magnet 2 is, as shown in FIG. 2, inserted into the deepest portion of an explosive charging hole 4 provided on a face 3, at the rear of said explosive 1 are set explosives 5, a detonator 6 and a detonating fuse 7 in this order and said explosive charging hole 4 is closed with sand 8.

In this case it is desirable that a side on which the end surface of the permanent magnet 2 exposes in said explosive 1 points to the side of an open end of the explosive charging hole 4.

The reason therefor is, because the destructive power as shown by Q is added, a phenomenon in which no broken pieces of the permanent magnet remain in the face after blasting is gone and the shape of an explosive, upon inserting the permanent magnet thereinto, is not remarkably deformed.

In said explosive, it is desirable that the ratio of the diameter of the magnet to an explosive cartridge is 0.3 – 0.5 and that the tip of the magnet to be inserted is at least 10 cm away from the tip of the cartridge.

Besides, because the destructive property and demagnetizing property of a ferrite magnet increase depending upon the detonation power of the explosive, in the production of the ferrite magnet, it is calcined at a temperature less than 1000° C., the structure of the ferrite magnet is made hollow, besides short columnar ferrites having hollow holes are adhered to in a rod-like shape and the adhered ferrites are magnetized in a longitudinal direction or cracks are formed on the surface of a hollow rod-like magnet and such magnet is used sometimes.

Figure 3A:
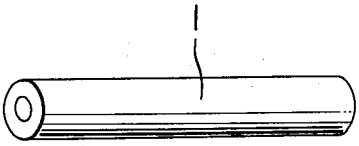
FIG. 3A and FIG. 3B are perspective views of hollow ferrite magnets for detecting a misfired explosive, respectively.
Figure 3B:
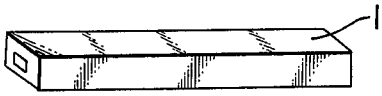

FIG. 3A and FIG. 3B are embodiments of the magnet for detecting a misfired explosive in which the structure of a ferrite magnet is made hollow, which are applicable to a blasting method the same as in the case of FIG. 2.

There is also a magnet substance for detecting a misfired explosive in which the structure of a magnet is such that a permanent magnet and a soft magnetic substance are combined in a rod-like state in the direction of the magnetic pole of said permanent magnet and there is also a magnet substance in which said magnet substance is made hollow.

The present invention also provides a magnet substance in which the absolute amount of a permanent magnet scattering by blasting and generating a magnetic field is made small, an object of which is to provide a magnet substance so improved as to be able to smoothly carry out detecting operations of a misfired explosive. Namely, when a misfired explosive exists, a magnetic field sufficiently detectable by a magnetic detector is generated, and when a misfired explosive does not exist, the permanent magnet and the soft magnetic substance are easily separated and destroyed by blasting and scatter in a site of explosion, however, because the magnetic field originally generated by the soft magnetic substance per se separated from the permanent magnet is feeble, said soft magnetic substance does not affect the detecting operation.

And because the absolute amount of the scattered permanent magnet is small and the powder of the soft magnetic substance so scatters as to cover the small pieces of the permanent magnet, the magnetic field generated by the small pieces of the permanent magnet is demagnetized and an extent of generating a magnetic field affecting the detecting operation of a misfired explosive decreases.

Figure 4A:
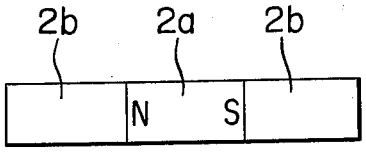
FIG. 4A, 4B and FIG. 4C are longitudinal sections showing respective embodiments of a permanent magnet used for the present invention, respectively.
Figure 4B:
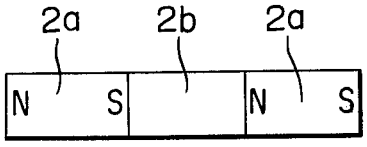
Figure 4C:
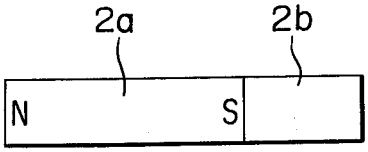

Embodiments of the aforesaid magnet substance are shown in FIG. 4, in which reference numeral 2a designates a permanent magnet and reference numeral 2b designates a soft magnetic substance. In FIG. 4A, the permanent magnet 1 is inserted between the soft magnetic substances 2b. In FIG. 4B, the soft magnetic substance 2b is inserted between the permanent magnets 2a, which is a structure promoting smash of the permanent magnet. In FIG. 4C, the permanent magnet 2a and the soft magnetic substance 2b are simply combined, which is a structure in which combination of magnet substances is easy.

Figure 5:
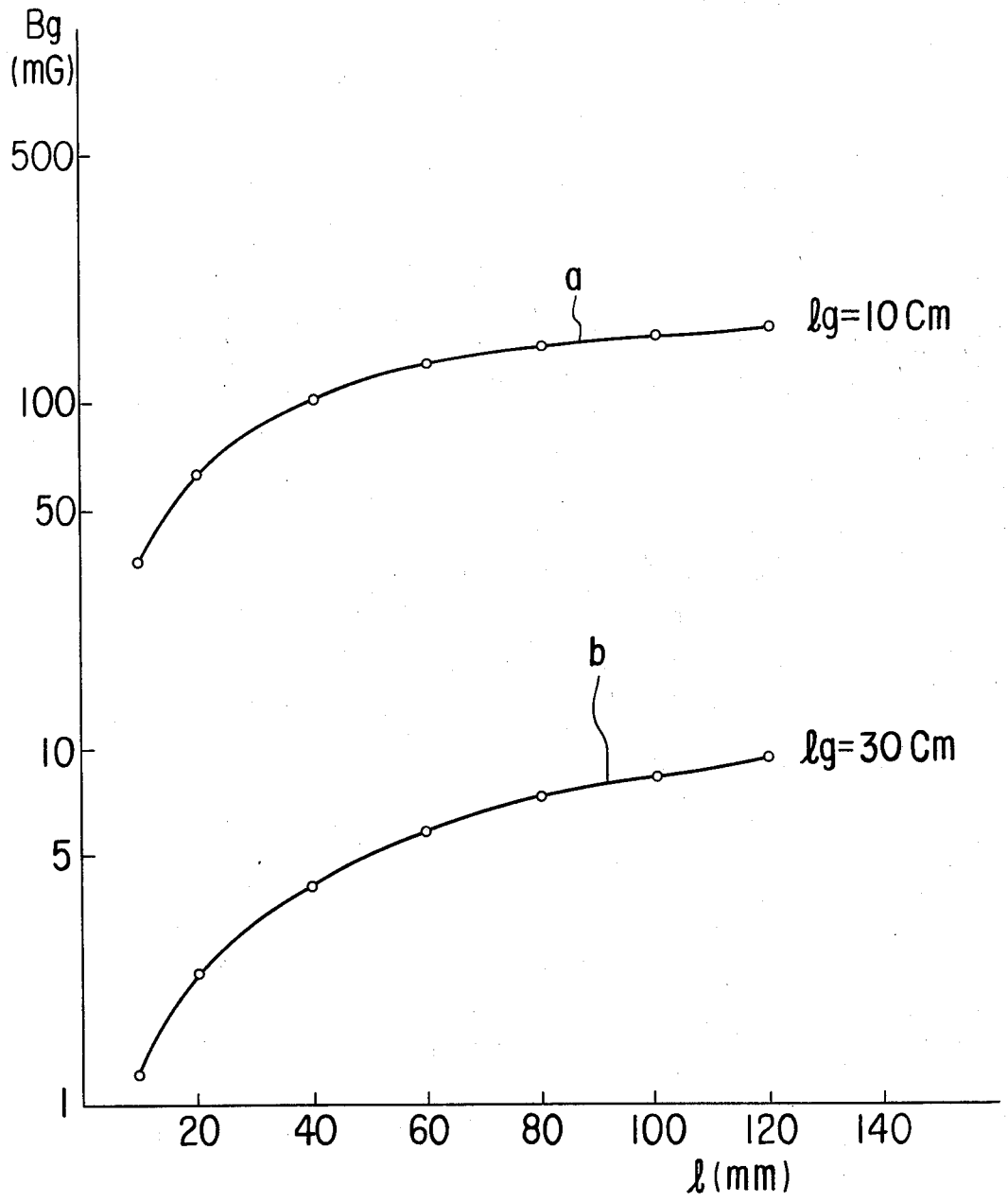
FIG. 5 is a graph showing the relation between the length of a ferrite magnet and the strength of a magnetic field thereof.

FIG. 5 is a graph showing relation between the length of a cylindrical ferrite magnet having a diameter of 10 mm of diameter of the hollow portion of 3.4 mm when the lengths lg's (detecting distance) are made lg=10 cm and lg=30 cm and the strength of a magnetic field of said magnet. In curve *a*, lg=10 cm and in curve *b*, lg=30 cm.

From FIG. 5, it is understood that the longer becomes the length l of a magnet, the more increases the strength of a magnetic field of a position away from the end surface of the magnet by a certain distance, which means that it is possible to obtain the desired strength of the magnetic field by combining a permanent magnet with a soft magnetic substance and adjusting the length of the resulting magnet substance.

In a magnet substance in which the components are combined in a structure shown by *b* of FIG. 5, when the length of the permanent magnet is called *l* and the length of the soft magnetic substance is called L, the strength of the magnetic field when lengths *l* and L are as varied as to make the total length of the magnet substance $L + 2l = 120$ mm and when the distance from the end surface of the magnet substance is respectively varied, is measured. The magnet substance is columnar in shape having a diameter of 10 mm. The results are shown in Table 1.

Table 1

| Distance cm | l = 10 L = 100 | l = 20 L = 80 | l = 30 L = 60 | l = 40 L = 40 | l = 50 L = 20 |
|---|---|---|---|---|---|
| 80 | 0.2 (mG) | 0.4 (mG) | 0.4 (mG) | 0.4 (mG) | 0.4 (mG) |
| 75 | 0.3 | 0.5 | 0.45 | 0.5 | 0.5 |
| 70 | 0.4 | 0.6 | 0.5 | 0.6 | 0.6 |
| 65 | 0.5 | 0.7 | 0.6 | 0.8 | 0.8 |
| 60 | 0.6 | 0.7 | 0.7 | 0.9 | 1.0 |
| 55 | 0.8 | 1.1 | 1.1 | 1.3 | 1.3 |
| 50 | 1.0 | 1.5 | 1.6 | 1.8 | 1.9 |
| 45 | 1.5 | 2.0 | 2.2 | 2.4 | 2.6 |
| 40 | 2.2 | 2.9 | 3.2 | 3.5 | 3.7 |
| 35 | 3.3 | 4.4 | 4.2 | 5.3 | 5.6 |
| 30 | 5.2 | 7.0 | 7.9 | 8.5 | 9.0 |
| 25 | 9.0 | 12.0 | 13.4 | 14.4 | 15.3 |
| 20 | 16.8 | 22.1 | 24.7 | 26.6 | 28.2 |
| 15 | 36 | 17.2 | 52.8 | 56.2 | 59.2 |
| 10 | 46 | 125 | 149 | 149 | 155 |

From table 1, it is understood that even when the amount of the permanent magnet is decreased, the length of the magnet substance combined with the soft magnetic substance is supplemented by the soft magnetic substance, therefore, the strength of the magnetic field hardly changes. From this fact, it is possible to decrease the amount of the permanent magnet and make the magnet substance an inexpensive magnet substance.

When a columnar magnet having a diameter of 10 mm and a length of 100 mm and a magnet substance according to the present invention in which a soft magnetic substance having a diameter of 10 mm and a length of 60 mm is inserted between columnar magnets each having a diameter of 10 mm and a length of 30 mm as shown in FIG. 5*b*, are blasted, in an explosive charging system shown in FIG. 2, the ratio of magnetism remaining in the explosive hole as a result are shown in Table 2.

Table 2

| | Number used | Number of magnets whose magnetic fields are detected | Residual magnetic ratio (%) |
|---|---|---|---|
| Magnet monomer | 120 | 6 | 5 |
| Magnet substance according to the present invention | 120 | 2 | 1.7 |

As will be apparent from the above table, a magnet substance for detecting according to the present invention comes to have a ratio at which magnet pieces generating magnetic fields exist of 1/3 as compared with that of a conventional magnet monomer, by which how the magnet substance for detecting according to the present invention is effective will be understood. This fact is not only applicable to a magnet for detecting a misfired explosive, but also applicable to designing of a general magnet.

As other embodiments of inserting the foregoing rod-like or hollow rod-like ferrite magnet into an explosive, FIG. 6 through FIG. 9 are shown.

Figure 6A:
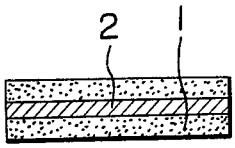
Figure 6B:
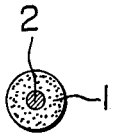
Figure 7A:
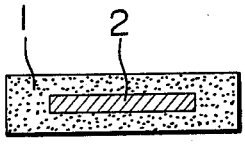
Figure 7B:
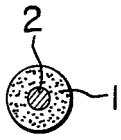
Figure 8A:
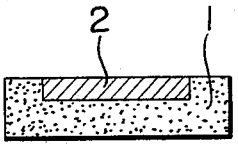
Figure 8B:
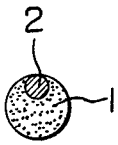

In an embodiment shown in FIG. 6, a ferrite magnet 2 is penetratingly inserted in a lengthwise direction into an explosive 1. In an embodiment shown in FIG. 7, an entire ferrite magnet is buried in an explosive 1. In an embodiment shown in FIG. 8, a ferrite magnet 2 is disposed on the outer periphery of an explosive along the lengthwise direction thereof.

Figure 9A:
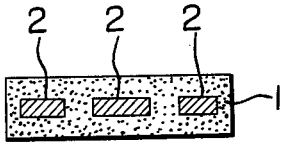
Figure 9B:
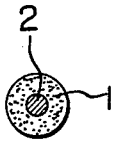

Further, in an embodiment shown in FIG. 9, a plurality of ferrite magnets 2 is buried at regular intervals along the central axis in an explosive 1. b. An explosive in which at least a part of a permanent magnet (rod-like or hollow rod-like magnet) whose surface has been insulated is covered with an explosive. An object of producing this explosive is to provide an explosive whose structure is so improved as not to leave broken pieces of a permanent magnet on a face after blasting when an explosive charged in an explosive charging hole explodes completely and as to ensure precise detection of a misfired explosive.

The permanent magnet inserted into the explosive is made hollow or cracks are formed on the surface thereof, or small pieces of a permanent magnet are adhered to one another and thereafter the adhered permanent magnet is insulated for promoting pulverization and demagnetization at the time of explosion.

The practice of this explosive is according to FIG. 1 and FIG. 2. The method of inserting the magnet into the explosive is same as shown in FIG. 6, FIG. 7, FIG. 8 and FIG. 9. c. An explosive, with which ferrite powder is mixed so that the existance thereof may be detected by a magnetic detector.

The present invention charges said explosives in a drilled hole and when a misfired explosive remains in the drilled hole by the misfire after blasting, said explosive is easily detectable by a magnetic detector. Namely, because it is a magnetized explosive, a magnet in the magnetized explosive exploded by blasting scatters in pieces or is demagnetized and because the explosive remaining by the misfire is magnetized, it is easily detectable by a magnetic detector. Methods of charging and blasting this explosive are exactly the same as what have heretofore been practiced. Also a method of detecting magnetism is the same as the case of what is mentioned above. And a misfired explosive scattered in a muck by blasting is also easily detectable by a magnetic detector.

Besides, the present invention provides an explosive in such structure as to prevent theft by utilizing the magnetism or confirm its location.

Heretofore, the custody and handling of an explosive such as dynamite have been strictly maintained based on the laws, in spite of which such explosive has been frequently lost or stolen.

Because there is a fear that a secondary disaster is caused by such missing or theft of the explosive, a countermeasure has been wished eagerly for easily locating the explosive when it is lost and immediately detecting the explosive when it is stolen.

The present invention is proposed in view of such actual situations, relating to an explosive which comprises mixing ferrite powder (or, for example, electrically insulated metal powder comprising immersing metal powder in a resin or rubbery resin, stirring and covering the metal surface with said resin, heating and drying the powder with further stirring and repulverizing the covered metal powder) with an explosive in advance, thereafter, magnetizing the explosive so as to cause the location of the explosive to be detected by a magnetic detector. An object of producing said explosive is to provide an improved explosive whose location can be easily found when it is lost and the attempted theft thereof can be immediately detected.

In the present invention, as mentioned above, the explosive per se being magnetized, it becomes possible to detect as magnetic flux generating from the explosive by a magnetic detector and the location or transfer of the explosive is easily confirmable.

However, upon magnetizing an explosive, it is necessary to unite a magnet with the explosive from the nature thereof. For example, in case an explosive and a permanent magnet are disposed face to face, when an induced current flows in the permanent magnet, there is a fear that the explosive may explode because of that.

Whereas, in the present invention, as mentioned above, because the explosive is magnetized after it is mixed with ferrite powder (or electrically insulated metal powder) and shaped in a predetermined shape, it is possible to remove such danger as mentioned above.

As such, an explosive according to the present invention being magnetized, should the explosive be lost at a site of construction, etc., it is possible to safely and certainly find the explosive without requiring many hands by investigating the neighborhood of a place where it is lost by a magnetic detector.

As a countermeasure for preventing an explosive from being stolen, a theft accident of this kind can be prevented in advance by disposing magnetic detectors at the entrance and exit of an explosive storage or at the entrance and exit of a site of blasting and other important positions.

Hereinbelow, an embodiment of the present invention will be explained.

At first, in the manufacturing step of an explosive, ferrite powder calcined at a temperature less than 1000° C. is mixed with the explosive, the mixture is shaped in a predetermined shape and thereafter magnetized. In this case, a mixing ratio of the ferrite powder with the explosive is appropriately 3 – 30%, more preferably 3 – 15%.

As a countermeasure for preventing the explosive so magnetized above from being stolen, magnetic detectors connected to a warning equipment are disposed on roads leading to an explosive storage or the explosive storage is surrounded by a wall and the magnetic detectors are disposed at the entrance and exit of such wall.

Accordingly, when said explosive magnetized are put in a bag or so and attempted to be taken out, the magnetism generating from the explosives is detected by a magnetic detector disposed on the ground at the entrance or exit as mentioned above and it is immediately reported and the theft of the explosives is prevented.

And when the explosive magnetized as mentioned above according to the present invention is lost in a site of construction, even if the lost explosive is covered with soil and in an invisible state, the location thereof can be simply confirmed by said magnetic detector.

As such, according to the present invention, the location and transfer of an explosive are simply, safely and certainly carried out, thereby a lost explosive can be easily found, at the same time, the theft of the explosive is prevented in advance, and after blasting, the existence of a misfired explosive can be easily and certainly detected. At this time, according to the present invention, the explosive per se being magnetized, certain detection of a misfired explosive is carrid out, and the labor of charging the magnet together with the explosive can be saved and more certain investigation of a misfired explosive is carried out.

As a magnetic detector used for investigation of an explosive according to the present invention, for decreasing the influence from steel structures at a site of construction and avoiding the influence of the terrestrial magnetic field, it is recommendable to use, for example, two detecting elements of a flux gate system and use a differential magnetic detector, the output of the two detecting elements of which is made differential. d. A short columnar ferrite permanent magnet for detecting a misfired explosive to be inserted to the tip of an explosive charging hole:

It comprises charging a ferrite magnet together with an explosive in an explosive charging portion in a blasting method and indirectly detecting a misfired explosive by investigating a magnetic flux at a site of explosion with a magnetic detector, and object thereof resides in providing a process for detecting a misfired explosive capable of more accurately and more simply confirming a misfired explosive by a simple structure.

In the present invention, as mentioned above, a ferrite magnet is charged together with an explosive in an explosive charging hole provided in a face and said spot is investigated by a magnetic detector for the ferrite magnet after blasting and when the explosive charged as mentioned above completely explodes, the ferrite magnet charged together with the same explosive scatters, therefore, no reaction appears on the magnetic detector. However, in case a misfired explosive exists, said ferrite magnet coexists with the misfired explosive, therefore, a reaction appears on the magnetic detector, and thus the existence of the misfired explosive is detected. An according to the present invention, it is so adapted that the magnetic flux of the ferrite magnet remaining with the misfired explosive is detected by the magnetic detector to indirectly detect the misfired explosive, therefore, even when the hole in which the misfired explosive exits is blocked by surrounding earth and sand, said misfired explosive can be easily detected, which is not only effective for prevention of an accident, but also advances the operability.

As a permanent magnet charged together with an explosive in said explosive charging portion, whose magnetic flux is to be detected by a magnetic detector, all permanent magnets are usable, however, in order to prevent demagnetization, what has a coercive force of more than 500 oersteds, and because the explosive and the surface of the magnet are used in direct contact in many cases, a magnet having a surface having a high electric resistance and having neither combustibility nor inflamability toward friction or impact is required. Therefore, for example, a ferrite magnet manufactured from iron exide by a ceramic technology is suitable. A ferrite magnet has a low curie point of about 450° C, therefore, it is presupposed to be demagnetized by a high temperature at the time of explosion which reaches above 2000° C. and because the material is brittle, the ferrite magnet scatters in pieces by an impact at the time of explosion, such magnet has been an effect of not giving birth to a useless magnetic field during the measuring after blasting. It is of course possible to use other metallic magnets after subjecting them to an insulation treatment.

A ferrite permanent magnet adheres short cylindrical magnets to one another to make it a magnet having a necessary lenght or is made hollow or cracks are formed on the surface to seek pulvarization and demagnetization of the magnet by blasting.

Upon manufacturing said magnet, it is calcined at a temperature less than 1000° C. to seek lowering of the hardness with a view to increasing pulverization and demagnetization of the magnet upon explosion.

Hereinbelow, the present invention will be explained by reference to illustrated embodiments.

Figure 10:
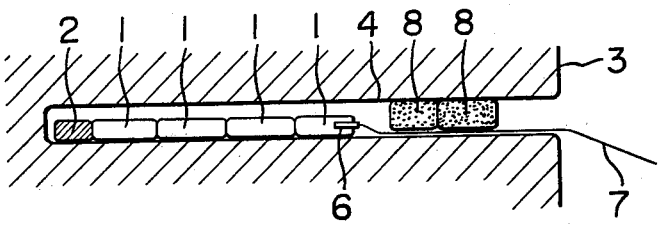
FIG. 10 and FIG. 11 are longitudinal sections showing embodiments of the process of the present invention, respectively.

As shown in FIG. 10, a ferrite magnet 2 is charged in the deepest portion of an explosive charging hole 4 provided in a face 3, and in contact with said ferrite magnet 2, an explosive 1, a detonator 6 and a detonating fuse 7 are charged in this sequence and the front surface of said hole 4 is blocked with sand 8.

Figure 11:
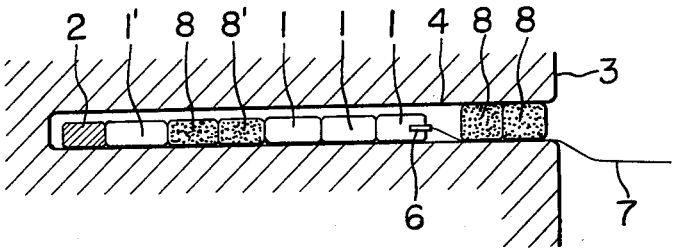

FIG. 11 shows the experimental method of charging an explosive and a ferrite magnet by which sand 8, 8' is interposed between explosives 1, 1' adjacent to a ferrite magnet 2 to intentionally remain the ferrite magnet 2, which is found by a magnetic measuring instrument to confirm the effect by this process.

Figure 12:
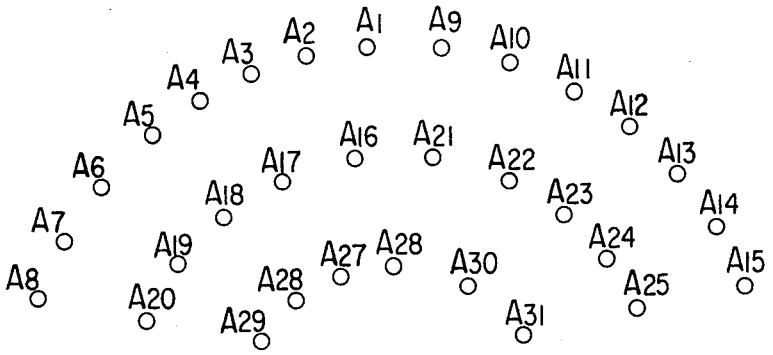
FIG. 12 is a front elevation of a face, showing an arrangement of blasting holes.

FIG. 12 shows a front elevation of a face 3, wherein $A_1$ through $A_{31}$ show explosive charging holes, in $A_{27}$, $A_{28}$, $A_{30}$ and $A_{31}$ of which are charged explosives and ferrite magnets by a system shown in FIG. 11 and in the rest of the holes are charged explosives and ferrite magnets by a system shown in FIG. 10 and said face 1 is exploded.

After blasting, as a result of seeking the magnetic fluxes at explosion sites by a magnetic measuring instrument, in the holes $A_{28}$ and $A_{31}$ adopting a charging system shown in FIG. 11, there are reactions and when confirmation is made by a predetermined system, misfired explosives and ferrite magnets are confirmed as is expected. However, in the holes $A_{27}$ and $A_{30}$, explosion is complete and no reaction appears on the magnetic measuring instrument.

Further, when other sites are visually investigated, in spite of using the charging system shown in FIG. 10, it appears that explosion is incomplete in the holes $A_8$, $A_{12}$, $A_{14}$ and $A_{23}$, so when investigation is made by a magnetic measuring instrument, reactions are shown, therefore, when configuration is made, explosives and ferrite magnets are found.

As will be apparent from the foregoing, a misfired explosive which has heretofore been found only with the naked eye or manual operations is doubly confirmed by visual inspection and detection of magnetic fluxes by a magnetic measuring instrument and is easily and certainly found according to the present invention, therefore, the safety of the operation drastically advances.

As a magnetic measuring instrument used in the present process, in order to reduce the incluence of iron construction materials in the site of construction and avoid the influence of the terrestrial magnetic field, for example, a differential magnetic measuring instrument (a magnetic field intensity meter consists of two differential probes) in which two detecting elements of a monoaxial system are used and the outputs thereof are made differential or a triaxial magnetic measuring instrument (total field magnet meter) in which detecting elements are disposed at right angles with X, Y and Z directions, is preferable.

Figure 13:
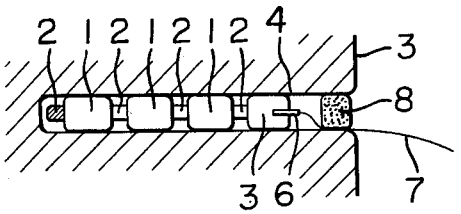
FIG. 13 and FIG. 14 are longitudinal sections showing other embodiments of the process of the present invention, respectively.
Figure 14:
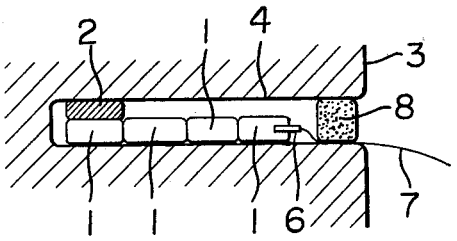

Again, in the present process, when a ferrite magnet is charge together with an explosive, besides the aforesaid various embodiments, as shown in FIG. 13, a ferrite magnet 2 may be disposed between each adjacent explosives 1, 1 to carry out further certain detection of a misfired explosive, or as shown in FIG. 14, a ferrite magnet 2 may be charged in contact with the side surface of an explosive 1 to cause the ferrite magnet 2 to completely scatter at the time of explosion. Furthermore, upon wrapping an explosive, the explosive and a ferrite magnet may be united in advance and wrapped. In the drawing, the equivalent portions to the aforesaid embodiments are attached witht the same marks.

The structural characteristics of a detector;

The present invention also provides a magnetic detector used, after a magnet is charged together with an explosive in an explosive charging portion in a blasting method, for indirectly detecting a misfired explosive after blasting.

We proposed a process which comprises charging a magnet together with an explosive in an explosive charging portion and indirectly detecting a misfired explosive by a magnetic detector after blasting, namely, a process by which, when a misfired explosive exist, the explosive exists together with the magnet in the explosive charging portion, the magnetism of said magnet is detected by a magnetic detector to thereby confirm the existence of the misfired explosive, on the other hand, when a misfired explosive does not exit, the magnet disposed in the explosive charging portion is destroyed by blasting and scatters, therefore, there is no generation of magnetism by said magnet, and the magnetic detector does not show any reaction to thereby confirm non-existence of a misfired explosive.

A magnetic detector used in the foregoing process is used in a face where blasting is carried out, however, many steel materials are used in the vicinity of the face and these steel materials are magnetized by the terretrial magnetic field and charged with an induced magnetism. Because of this, a strong magnetic field comes to exist around these steel materials. The magnetic field by this induced magnetism becomes a signal liable to be confounded with a magnetic field created by a magnet remaining with the misfired explosive upon detecting the misfired explosive, namely, a magnetic field to be detected, being detected by a magnetic detector, becoming a reason for overlooking a magnetic field to be detected by a magnetic detector which should be originally detected or interfering with the detecting operation because a magnetic field is detected by the magnetic detector despite there is no misfired explosive. Because of that, upon detecting a misfired explosive, it is earnestly wished to advance the capacity discriminating a magnetic field due to the induced magnetic effect of steel materials from a magnetic field to be detected.

Therefore, we examined a possibility of solving this problem by making a magnetic field to be detected larger than a magnetic field generated by the induced magnetic effect of steel materials in order to advance the capacity discriminating the magnetic field due to the induced magnetism of steel materials from the magnetic field to be detected, as a result, it turns out to be impossible from the following reasons. In order to make large a magnetic field to be detected, suffice it to make high the coercive force of a mganet to be disposed in an explosive charging portion and further design the magnetic field so as to reach a compartively long distance, however, for that end, either the size of the magnet is made large or even if the magnet is small, it becomes expensive, lacking generality in any way. Furthermore, a magnet high in magnetism scatters by blasting, by which it is made more difficult to discriminate from a magnetic field to be detected.

As a result of further study, however, we have found that the aforesaid problem will be solved by improving the magnetic detector. Namely, by selecting a distance between the aforesaid two magnetic detecting elements (probes) of the magnetic detector for detecting a misfired explosive in which the detecting outputs of the two magnetic detecting elements are made differential within the range of 10 – 30 cm, discrimination of a magnetic field due to the induced magnetic effect of the steel materials from a magnetic field to be detected has been carried out with high accuracy.

The present invention also relates to a magnetic detector for detecting a misfired explosive in which a distance between two magnetic detecting elements is made within the range of 10 – 30 cm as mentioned above, an object thereof resides in providing a magnetic detector for detecting a misfired explosive advancing the capacity discriminating a magnetic field due to an induced magnetic effect of steel materials from a magnetic field to be detected.

Usually, in a site of construction for blasting a rock tunnel, rails for running freight cars carrying dug rocks or ores out of the tunnel or a mine, machines for loading the rocks or ores aboard the freight cars or a timbering by steel materials for reinforcing the dug portions are used, and they are located within the proximity of a face. Especially, the timbering is constructed by the face surfaces immediately after the rocks or ores are removed after blasting is completed for the safety of operations, and because the timbering is located along the outside of the face, the influence of a magnetic field due to an induced magnetic effect by the timbering is the largest.

The distance between the timbering after blasting and the face surface is equivalent to a dug length per one blasting, which is ordinarily about 1.5 – 2.5 m. The dug length is decided by the cross sectional area of the face of the tunnel. In case the cross sectional area of the face is small, the dug length per one blasting is short and the unit weight of the timbering is small. Accordingly, a magnetic field reached by the induced magnetic effect becomes narrow. As such, there is a convenient aspect for digging operations when the cross sectional area of the face is small. However, one timbering weighs several hundred kg and around the timbering, a strong magnetic field due to the induced magnetic effect is to exist.

On the other hand, in case a misfired explosive into which a magnet is inserted is detected by a magnetic detector, the distance reached by the magnetic field of a magnet varies depending upon the material of the magnet, size of a residual magnetic flux density and volume of the magnet, however, a practically effective reaching distance is 30 – 40 cm from the end surface of the magnet. Accordingly, in case a detecting operation of a misfired explosive is carried out in a face, because the distance from the face surface and the timbering is about 1.5 m, when the influence of a magnetic field due to the induced magnetic effect from the timbering is considered, the longer is the distance between the two detecting elements of a magnetic detector in the case of general use, the better becomes the sensitivity. However, when the distance between the detecting elements is made longer, the stronger influence of a magnetic field due to an induced magnetic effect from the timbering is undergone. Therefore, the distance between the two detecting elements disposed on the same axis is restricted to within 30 cm.

Hereinbelow, the present invention will be explained by reference to the remaining drawings.

Figure 15:
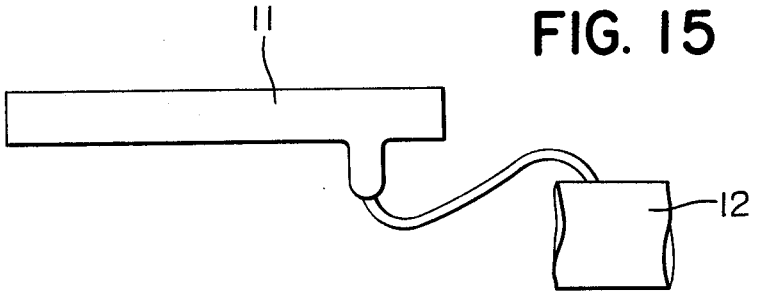
FIG. 15 is a schematic view showing an outline of a magnetic detector used in the present invention.

FIG. 15 is a sketch of a magnetic detector, in which reference numeral 11 denotes a detecting rod and reference numeral 12 denotes the measuring part of the detector.

Figure 16:
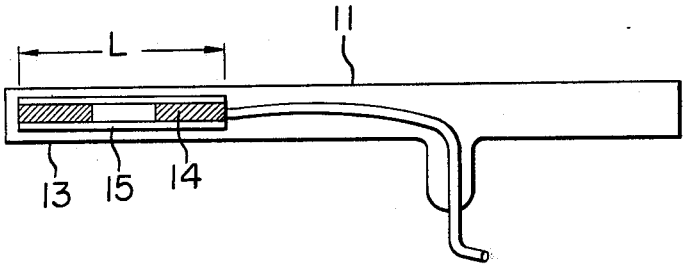
FIG. 16 is a section of a detecting rod.

FIG. 16 is a section of the detecting rod, in which reference numerals 13 and 14 denote detecting elements and reference numeral 15 shows a cylinder accommodating the detecting elements.

In FIG. 16, distance L between the detecting elements 13, 14 is made 30 cm, 25 cm, 20 cm, 15 cm and 10 cm, and an isotropic ferrite magnet having an outer diameter of 10 mm and a length of 120 mm is used in measuring magnetic fields to be detected, the distances from the magnet to the tip of the detecting elements are 30 cm and 60 cm.

The ratio of magnetic fields to be detected when distance L between the detecting elements are 30 cm and 15 cm at this time, is 1.22 times when L is 15 cm as compared with a case wherein L is 30 cm, the same ratio when the distance L between the detecting elements are 20 cm and 10 cm is 1.18 times when L is 10 cm as compared with a case wherein L is 20 cm, which means that the shorter is the distance between the two magnetic detecting elements, the more improved is the sensing ratio. Namely, by making narrow the distance between the two magnetic detecting elements of a magnetic detector, it is possible to make large the ratio of a magnetic field due to a magnet inserted into an explosive to a magnetic field due to an induced magnetic effect of steel materials used round the face and it is possible to heighten the detecting accuracy.

From the foregoing, it is seen that by making a distance L between two detecting elements disposed on the same axis as narrow as possible, it is possible to make smaller the influence of a magnetic field due to the induced magnetic effect from the timbering, however, the narrower is made L, the weaker becomes the strength of a magnetic field to be detected and reaches an error inherently possessed by the detector. Therefore, according to the actual experimental results, it is practically impossible to make L less than 10 cm.

In the foregoing, the present invention is explained by reference to embodiments, however, it should be noted that the present invention is not limited to these embodiments, but various modifications of design are possible within the range without departing from the gist of the present invention.

What is claimed is:

1. A process for indirectly detecting a misfired explosive (cartridge) which comprises charging a ferrite magnet as a tracer in an explosive charging portion together with an explosive in a blasting method and detecting the magnetic flux of said magnet charged in a misfired explosive cartridge at a site of explosion after blasting by a magnet measuring instrument, characterized by using as said tracer a ferrite magnet calcined at a temperature less than 1000° C. and detecting this magnet by said magnetic detector.

2. A process for indirectly detecting a misfired explosive (cartridge) in a blasting method according to claim 1, wherein a ferrite magnet piece calcined at a temperature less than 1000° C. and formed in a hollow shape is used as said ferrite magnet.

3. A process according to claim 2, wherein a hollow cylindrical ferrite magnet piece is used as said ferrite magnet.

4. A process for indirectly a misfired explosive (cartridge) in a blasting method according to claim 1, wherein a magnet for detecting (tracer) which comprises combining a plurality of ferrite magnet pieces calcined at a temperature less than 1000° C. with soft magnetic substance pieces in a rod shape in the direction of the magnetic pole of said ferrite magnet pieces, is used as ferrite magnet.

5. A process according to claim 4, wherein the respective elements of said ferrite magnet pieces and said soft magnetic substance pieces shaped in a columnar state are used.

6. A process according to claim 4, wherein the respective elements of said ferrite magnet pieces and said soft magnetic substance pieces in hollow cylindrical shapes are used.

7. A process according to claim 6, wherein the inner diameters and the outer diameters of the respective elements of hollow cylindrical shapes are made 3 – 4 mm and 10 – 15 mm, respectively.

8. A process according to claim 4, wherein said magnet pieces for detecting (tracer) are inserted into an explosive cartridge.

9. A process according to claim 8, wherein, upon inserting said magnet pieces for detecting (tracer) into said explosive cartridge, the ratio of diameters of said magnet pieces for detecting to said explosive cartridge is made 0.3 – 0.5 and the tip of the inserted magnet pieces is made at least 1 cm away from the tip of said cartridge.

10. A process according to claim 1, wherein ferrite powder calcined at a temperature less than 1000° C, is mixed with said explosive and thereafter said explosive is magnetized.

11. A process according to claim 10, wherein said ferrite powder is mixed with said explosive in an amount of 3 – 20% based on said explosive.

12. A process according to claim 1, wherein the distance between two detecting elements disposed on the same axis on a detecting rod in the magnetic detector is made 10 – 30 cm.

* * * * *